US011214084B2

(12) United States Patent
Tamai et al.

(10) Patent No.: US 11,214,084 B2
(45) Date of Patent: Jan. 4, 2022

(54) RECORDING APPARATUS

(71) Applicant: SEIKO EPSON CORPORATION, Tokyo (JP)

(72) Inventors: Satoshi Tamai, Matsumoto (JP); Shingo Waki, Matsumoto (JP); Shintaro Komuro, Matsumoto (JP); Nobuhiko Shinozaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/083,781

(22) Filed: Oct. 29, 2020

(65) Prior Publication Data

US 2021/0129557 A1 May 6, 2021

(30) Foreign Application Priority Data

Oct. 31, 2019 (JP) ..... JP2019-198383

(51) Int. Cl.
*B41J 13/10* (2006.01)
*B41J 11/00* (2006.01)

(52) U.S. Cl.
CPC ..... *B41J 13/106* (2013.01); *B41J 11/006* (2013.01); *B41J 13/103* (2013.01); *B65H 2405/10* (2013.01); *B65H 2405/12* (2013.01)

(58) Field of Classification Search
CPC ..... B41J 13/106; B41J 13/103; B41J 11/006; B65H 2405/10; B65H 2405/12; B65H 2511/11; B65H 31/20; B65H 31/02; B65H 2405/11164; B65H 2403/411; B65H 2403/481; B65H 2801/06; B65H 29/58

See application file for complete search history.

(56) References Cited

U.S. PATENT DOCUMENTS

2005/0162494 A1* 7/2005 Inokuchi ..... B41J 13/106 347/104
2014/0319768 A1* 10/2014 Komuro ..... B65H 31/02 271/314
2018/0178563 A1* 6/2018 Tamai ..... B41J 13/106

FOREIGN PATENT DOCUMENTS

JP 2004-338873 A 12/2004

* cited by examiner

*Primary Examiner* — Henok D Legesse
(74) *Attorney, Agent, or Firm* — Workman Nydegger

(57) ABSTRACT

A recording apparatus includes a recording section that performs recording on a medium, a housing that houses the recording section, a tray configured to move to a loading position in which to load the medium to be subjected to recording and ejected and a stowage position in which the tray is stowed in the housing, and a switching unit that switches between an automatic mode in which to automatically move the tray to the loading position and the stowage position and a manual mode in which to manually move the tray to the loading position and the stowage position.

9 Claims, 12 Drawing Sheets

RECORDING APPARATUS

The present application is based on, and claims priority from JP Application Ser. No. 2019-198383, filed Oct. 31, 2019, the disclosure of which is hereby incorporated by reference herein in its entirety.

BACKGROUND

1. Technical Field

The present disclosure relates to a recording apparatus.

2. Related Art

Conventionally, there has been known a recording apparatus, such as a printer, that performs recording by ejecting a liquid onto a medium. Such a recording apparatus is configured such that a medium subjected to recording is ejected into a paper output tray. JP-A-2004-338873 discloses a configuration in which a paper output tray expands and contracts according to the length of a medium, and in accordance with a printing instruction, the paper output tray automatically expands and contracts to move to a designated position.

However, some users want to not automatically but manually move paper output trays to desired positions. On the other hand, the paper output tray disclosed in JP-A-2004-338873 can be automatically expanded and contracted, but cannot be manually expanded or contracted. This undesirably impairs the convenience with which the paper output tray expands and contracts.

SUMMARY

According to an aspect of the present disclosure, there is provided a recording apparatus including: a recording section that performs recording on a medium; a housing that houses the recording section; a tray configured to move to a loading position in which to load the medium to be subjected to recording and ejected and a stowage position in which the tray is stowed in the housing; and a switching unit that switches between an automatic mode in which to automatically move the tray to the loading position and the stowage position and a manual mode in which to manually move the tray to the loading position and the stowage position.

The foregoing recording apparatus may further include a control section that controls the switching unit. In the foregoing recording apparatus, the control section may switch between the automatic mode and the manual mode by controlling the switching unit.

The foregoing recording apparatus may further include: a gear train mechanism that moves the tray to the loading position and the stowage position; and a driving source that drives the gear train mechanism. In the foregoing recording mechanism, the switching unit may have a planet gear in the gear train mechanism, and switching between the automatic mode and the manual mode may be done by switching the planet gear from one position to another.

In the foregoing recording apparatus, the tray may have formed therein a rack that meshes with the gear train mechanism, the gear train mechanism may include a pinion that meshes with the rack, and a plurality of gears that transmits motive power to the pinion, in the automatic mode, the planet gear may be brought into a meshing state of meshing with the plurality of gears, and in the manual mode, the planet gear may be brought into a non-meshing state of not meshing with the plurality of gears.

In the foregoing recording apparatus, after the tray moves to the loading position or the stowage position in the automatic mode, the planet gear may move to a retreat position where the planet gear is in the non-meshing state of not meshing with the gear.

The foregoing recording apparatus may further include an operation section that inputs, to the control section, an instruction to switch between the automatic mode and the manual mode.

In the foregoing recording apparatus, the tray may be configured to move to a plurality of positions in the automatic mode.

In the foregoing recording apparatus, the tray may include a first tray and a second tray located upstream of the first tray in a direction of ejection of the medium in the loading position, and the second tray may be configured to move to a plurality of positions in the automatic mode.

DESCRIPTION OF EXEMPLARY EMBODIMENTS

1. Embodiment

A recording apparatus according to the present embodiment is schematically described. As an example of the recording apparatus, an ink-jet recording apparatus (hereinafter referred to as "recording apparatus 1") is taken.

Figure 1:
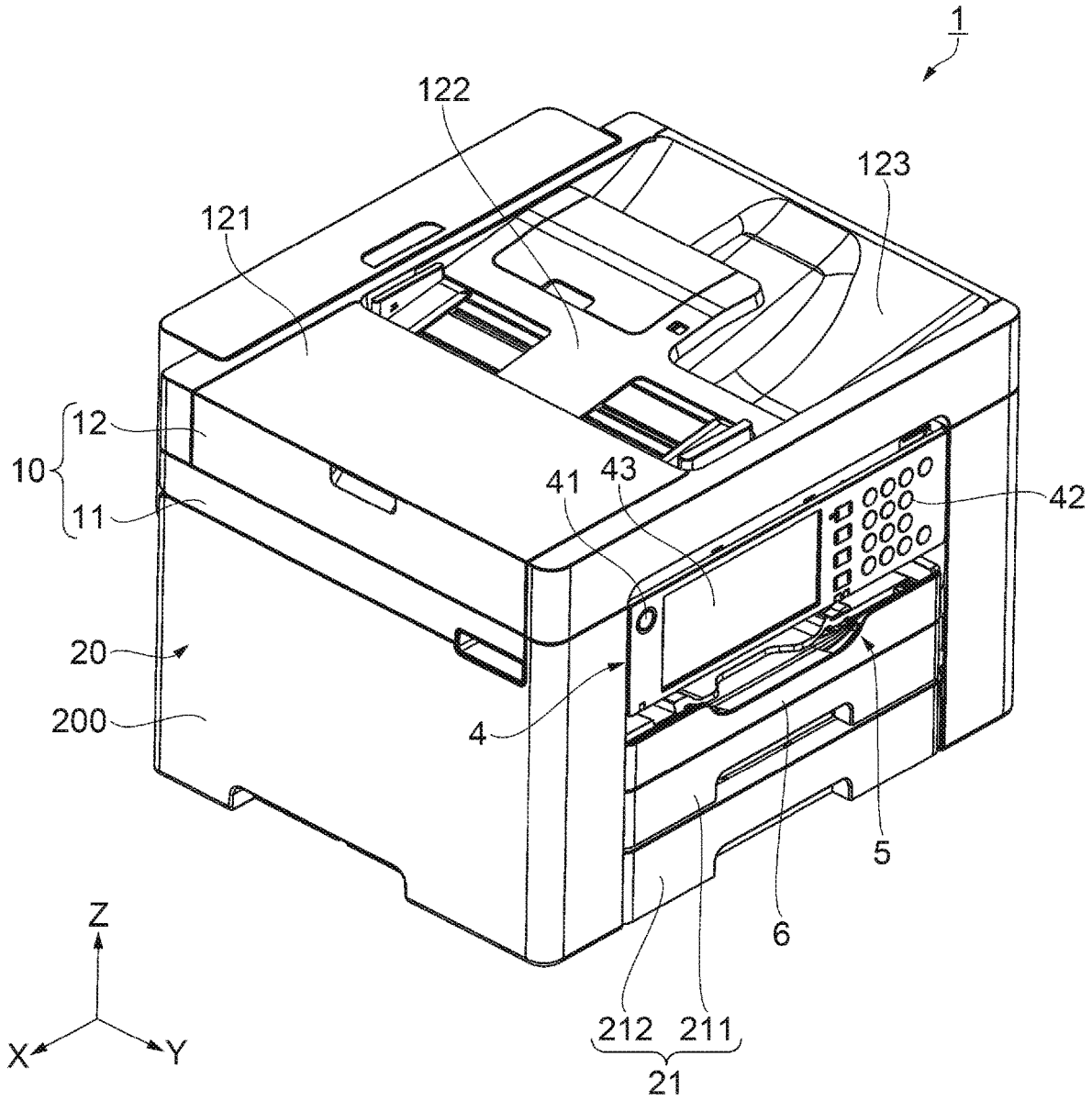
FIG. 1 is a perspective view showing a recording apparatus according to the present embodiment.
Figure 2:
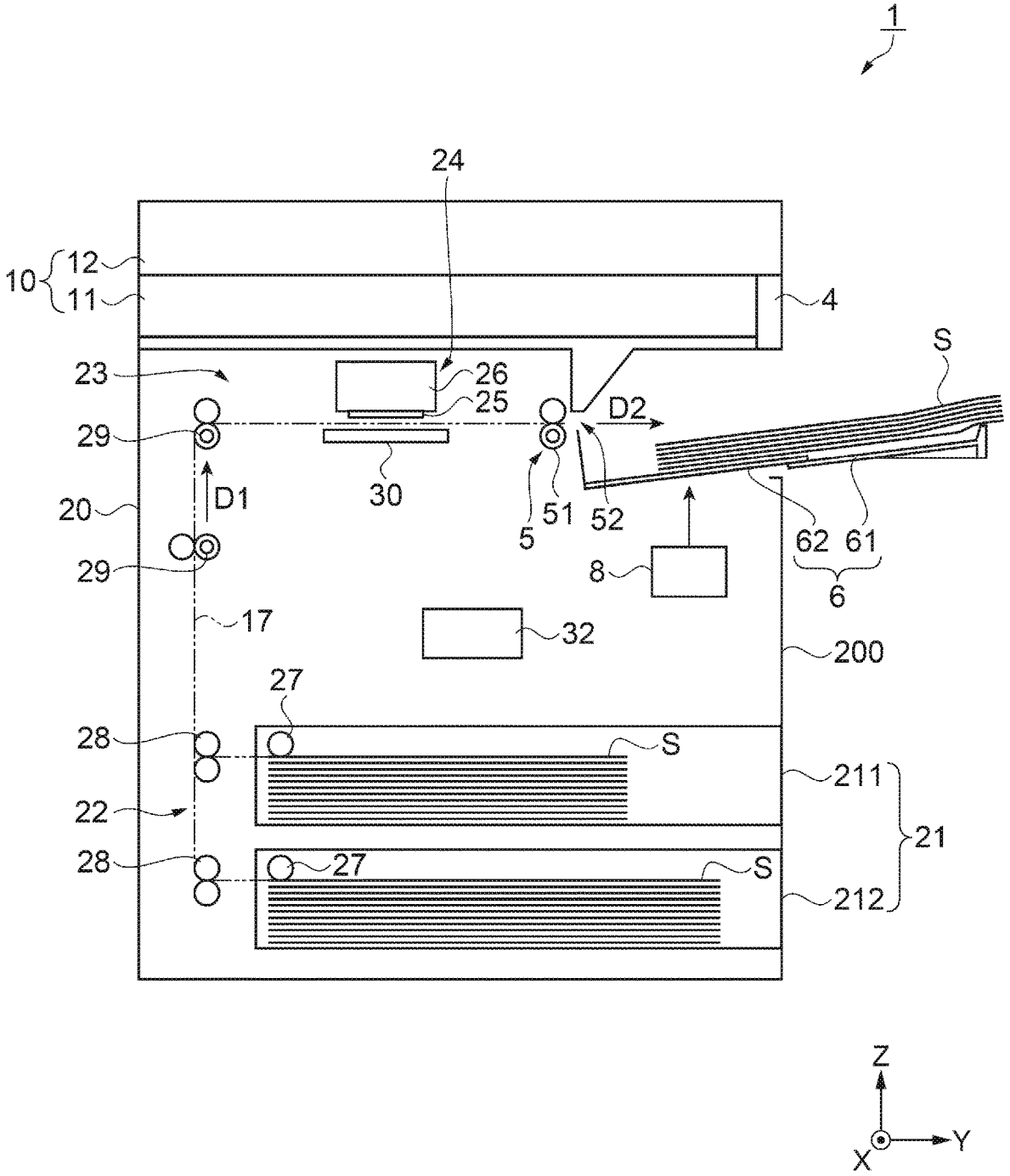
FIG. 2 is a cross-sectional view schematically showing a configuration of the recording apparatus.

FIG. 1 is a perspective view showing the recording apparatus 1 according to the present embodiment. FIG. 2 is a cross-sectional view schematically showing a configuration of the recording apparatus 1.

FIGS. 1 and 2 and the subsequent drawings are illustrated using an X-Y-Z coordinate system. An X direction is a width direction of a sheet of paper S serving as a medium on which recording is performed, and is a scanning direction of a recording head 25. A Y direction is a depth direction of the recording apparatus 1, and is a length direction of a sheet of paper S. A Z direction is a direction of gravitational force, and is a height direction of the recording apparatus 1.

Further, a direction toward a place or position that is in front of the recording apparatus 1 is referred to as "+Y direction", and a direction that is toward the back of or behind the recording apparatus 1 is referred to as "−Y direction". Further, when the recording apparatus 1 is seen from the front, a direction toward the left of or a leftward direction from the recording apparatus 1 is referred to as "+X direction", and a direction toward the right of or a rightward direction from the recording apparatus 1 is referred to as "−X direction". Further, a direction toward an upper side (including a higher position, an upper portion, an upper surface, and the like) of the recording apparatus 1 is referred to as "+Z direction", and a direction toward a lower side (including a lower position, a lower portion, a lower surface, and the like) of the recording apparatus 1 is referred to as "−Z direction".

A brief overview of the recording apparatus 1 is given with reference to FIGS. 1 and 2.

As shown in FIG. 1, the recording apparatus 1 of the present embodiment includes a recording unit 20 and a scanner unit 10 disposed on top of the recording unit 20, and is configured as a so-called multifunction printer.

The scanner unit 10 includes a first reading device 11 and a second reading device 12 disposed on top of the first reading device 11. The first reading device 11 is a flatbed scanner, and has a contact image sensor (not illustrated). A user exposes a document mounting surface (not illustrated), i.e. an upper surface of the second first reading device 11, by bringing the second reading device 12 into an open state with respect to the first reading device 11. Next, the user mounts a document to be read onto the document mounting surface thus exposed of the first reading device 11, closes the second reading device 12, and performs a predetermined switching operation through an operation section 4. This allows the first reading device 11 to read, as an image, characters, symbols, pictures, and the like drawn on the document mounted on the document mounting surface.

The second reading device 12 has a document feeding unit 121. The document feeding unit 121 feeds a document mounted on a document mounting tray 122 into the second reading unit 12. The second reading device 12 includes an ADF (automatic document feeder), reads a fed document as an image, and drops the document thus read into a document receiving tray 123.

The operation section 4, through which to operate the recording apparatus 1, is provided on the front of the recording apparatus 1. The operation section 4 is a horizontally long panel extending along the X direction, and is provided with a power button 41 that is operated in turning on or off the recording apparatus 1, an operation button 42 that is operated in inputting various types of operation information, and a display panel 43 configured to display an operating state and the like. The display panel 43 is for example a liquid crystal panel.

As shown in FIG. 2, the recording unit 20 has set therein a transport path 17 indicated by chain double-dashed lines, and a sheet of paper S is transported in a transport direction D1. The recording unit 20 is configured to include a paper cassette 21, a feeding section 22, a transport section 23, a recording section 24, an ejection section 5, a control section 32, and the like inside.

The paper cassette 21 is detachably placed in the lower portion of the recording apparatus 1. The paper cassette 21 is a holding section configured to hold a stack of sheets of paper S. The paper cassette 21 includes a paper cassette 211 that holds A4-size sheets of paper and a paper cassette 212 that holds A3-size sheets of paper.

The feeding section 22 feeds, to the transport section 23, a sheet of paper S held in the paper cassette 21. The feeding section 22 includes pickup rollers 27 each of which sends out the uppermost sheet of paper S of the stack of sheets of paper S held in the paper cassette 21 and separating roller pairs 28 each of which separates, one by one, sheets of paper S sent out by a corresponding one of the pickup rollers 27. Furthermore, the feeding section 22 includes a feeding motor (not illustrated) configured to drive the pickup rollers 27 to turn. Each of the pickup rollers 27 and each of the separating roller pairs 28 correspond to a corresponding one of the paper cassettes 211 and 212, in which sheets of paper S for use in recording (printing) are stacked, and are driven so that a sheet of paper S for use in recording is fed to the transport section 23.

The transport section 23 transports a fed sheet of paper S to the recording section 24. The transport section 23 includes transport roller pairs 29 that are driven by a transport motor (not illustrated) to turn, and transports a sheet of paper S along the transport path 17. Further, a platen 30 is provided in a position opposite to the recording section 24 so as to extend along the transport path 17. A sheet of paper S is transported while being sticking fast to a supporting surface (upper surface) of the platen 30.

The recording section 24 includes the recording head 25, which ejects ink serving as a liquid toward a sheet of paper S, a carriage 26 mounted with the recording head 25 and configured to be movable along a width direction (X direction) crossing the transport direction D1 (+Y direction) of a sheet of paper P, an ink cartridge (not illustrated) that supplies the recoding head 25 with the ink, or other components. The recording head 25 is provided in a position opposite to the platen 30 across the transport path 17.

The recording section 24 ejects ink based on recording data (printing data) onto a sheet of paper S being transported while being supported by the platen 30 and thereby performs recording (printing) by forming an image based on the recording data with adhesion of the ink. The recording data is data, generated based on image data such as text data or image data to be recorded on a sheet of paper S, that is used to cause the recording apparatus 1 to execute recording. A sheet of paper S subjected to recording is transported by the transport section 23 and sent to the ejection section 5, which is provided downstream of the recording head 25 in the transport direction D1.

The ejection section 5 uses a paper output roller pair 51 to eject a sheet of paper S subjected to recording into a tray 6 through an ejection port 52 along a direction of ejection D2. When sheets of paper S are continuously recorded and ejected, ejected sheets of paper S are stacked in sequence onto previously-ejected sheets of paper S.

The control section 32 performs control of driving of the feed section 22, the transport section 23, the recording section 24, the ejection section 5, or other components. The control section 32 exercises integrated control as the recording apparatus 1 in cooperation with a scanner control section (not illustrated) of the scanner unit 10.

The control section 32 of the present embodiment includes a function of, in performing an action of expanding and contracting the tray 6, switching between an automatic mode in which to automatically move the tray 6 to a loading position, shown in FIG. 2, in which to load a sheet of paper S and a stowage position, shown in FIG. 1, in which the tray 6 is stowed inside a housing 200 and a manual mode in which for the user to move the tray 6 to the loading position and the stowage position. In the manual mode, the loading position is a desired position to which the user has expanded the tray 6.

Figure 3:
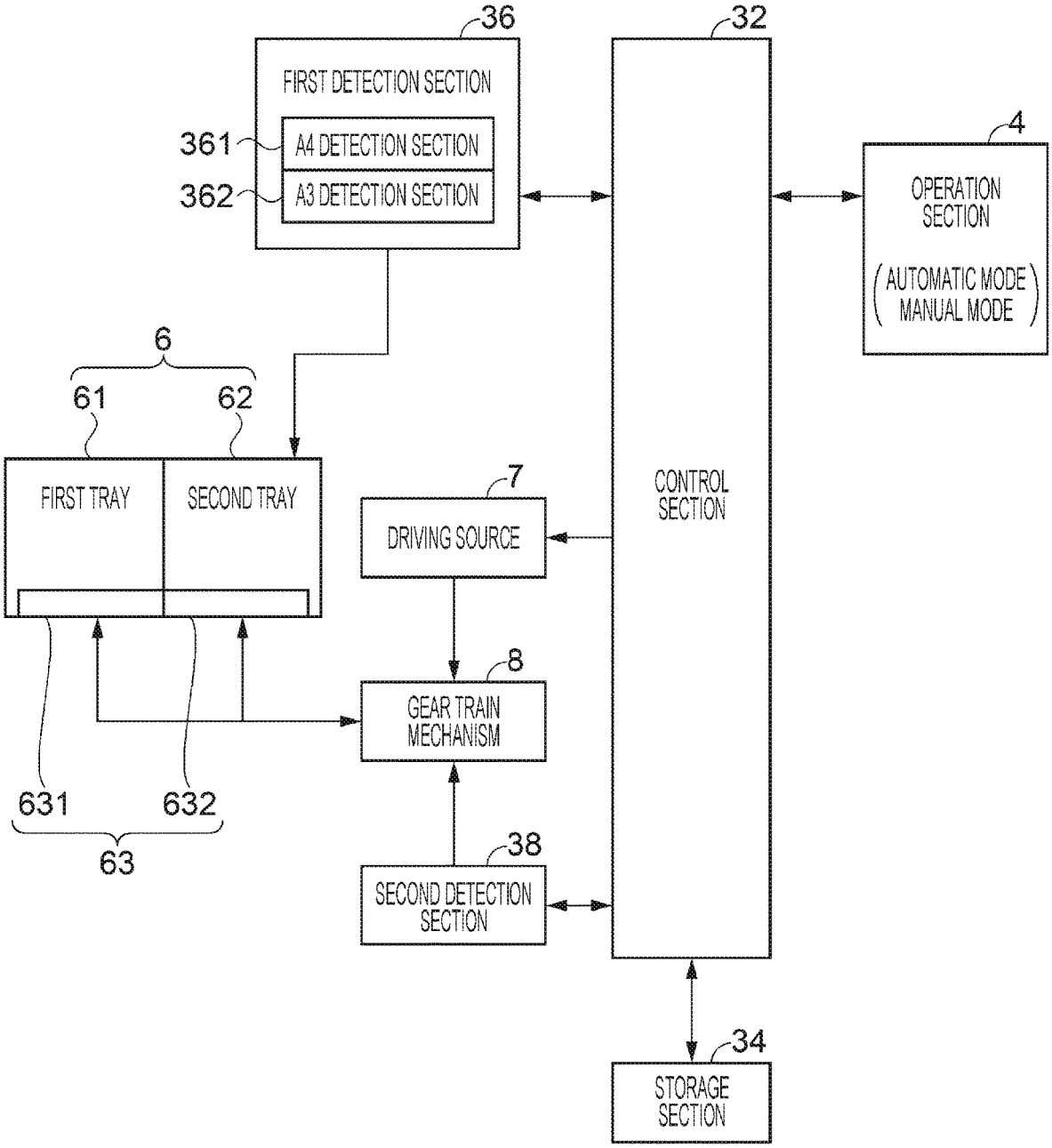
FIG. 3 is a schematic functional block diagram in expanding and contracting a tray.
Figure 4:
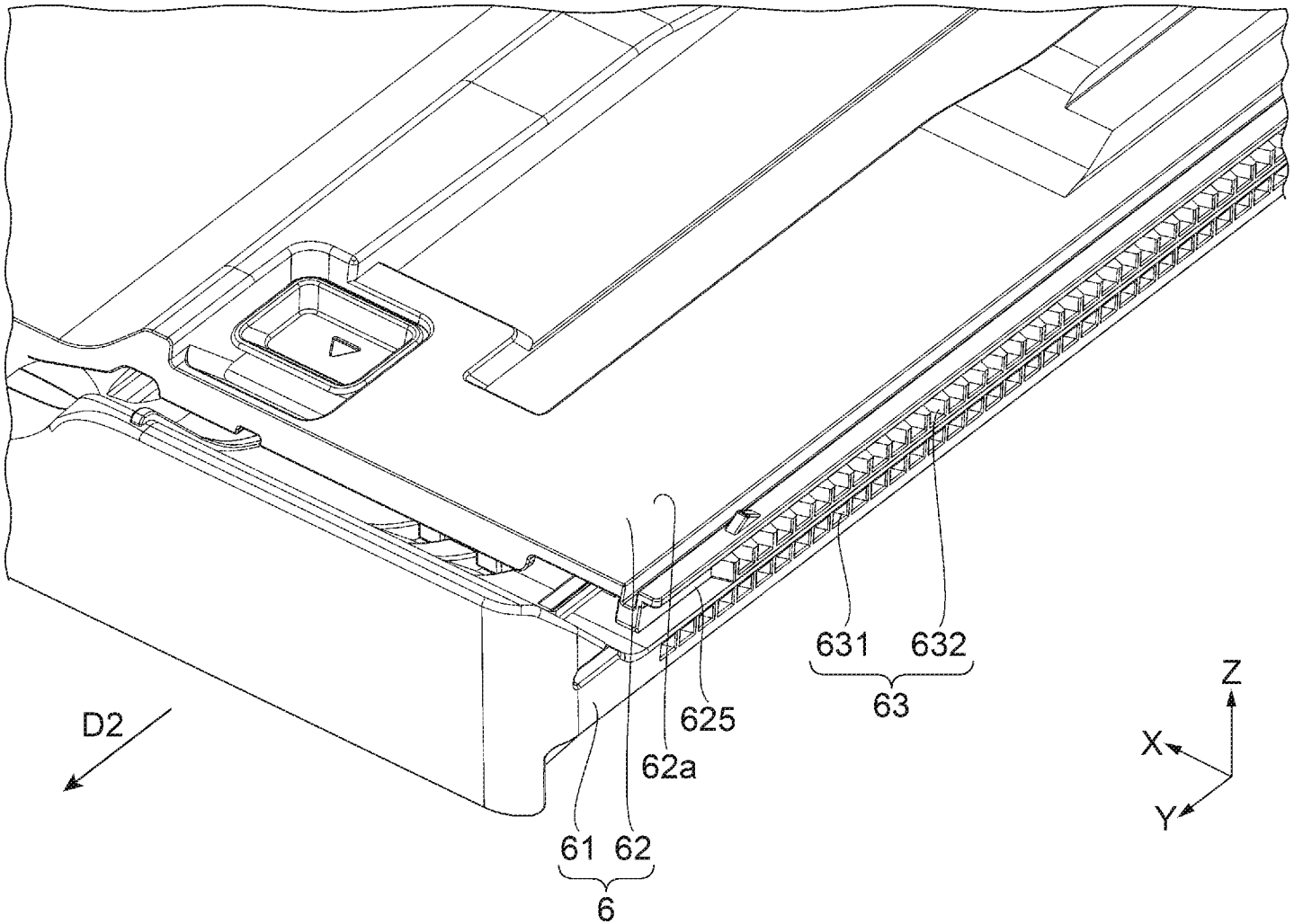
FIG. 4 is a perspective view showing a state of the tray in a stowage position.

FIG. 3 is a schematic functional block diagram in expanding and contracting the tray 6. FIG. 4 is a perspective view showing a state of the tray 6 in the stowage position.

As shown in FIG. 3, the functional blocks include the control section 32, a storage section 34, the operation section 4, a driving source 7, a gear train mechanism 8, a first detection section 36, a second detection section 38, and the tray 6. The control section 32 switches between the automatic mode and the manual mode in accordance with an instruction inputted through the display panel 43 of the operation section 4.

Specifically, in performing printing, the control section 32 causes the display panel 43, which is constituted by a touch panel, to perform a screen display that prompts for selection as to whether to perform the action of expanding and contracting the tray 6 in the automatic mode or the manual mode. Upon confirmation of this screen display, the user selects either the automatic mode or the manual mode by pressing the touch panel with a fingertip.

In the present embodiment, when in the automatic mode, the control section 32, in performing printing, causes the tray 6 to, within a period of time from the start of printing to the ejection of a sheet of paper S subjected to printing, move from the stowage position to a loading position suited to the size of a sheet of paper S to be subjected to printing. In the present embodiment, the size of a sheet of paper S is an A4 size or an A3 size.

The storage section 34 has stored therein various types of program that define the action of expanding and contracting the tray 6 in the automatic mode and the manual mode. When the automatic mode has been selected, the control section 32 reads various types of program stored in the storage section 34 and gives an instruction to actuate each component. When the manual mode has been selected, the control section 32 does not give a driving instruction to the driving source 7. Note, however, that when the manual mode has been selected, the control section 32 gives instructions to actuate the after-mentioned first and second detection sections 36 and 38 and retains detection results.

In the automatic mode, a driving motor 70 (see FIG. 7) that constitutes the driving source 7 is driven in accordance with an instruction from the control section 32, whereby the gear train mechanism 8 is set in motion. The motion of the gear train mechanism 8 causes motive power to be transmitted to a rack 63 formed in the tray 6. Transmission of the motive power to the rack 63 causes the tray 6 move to the loading position or the stowage position.

The first detection section 36 is constituted by a mechanical switch. The first detection section 36 is constituted by two detection sections, namely an A4 detection section 361 that detects arrival at a loading position in which to load an A4-size sheet of paper S and an A3 detection section 362 that detects arrival at a loading position in which to load an A3-size sheet of paper S. The control section 32 stops the driving source 7 in accordance with a detection result yielded by the first detection section 36.

The second detection section 38 is constituted by an encoder, and is placed in meshing engagement with a designated gear (in the present embodiment, a second gear 82) of the gear train mechanism 8. The section detection section 38 detects the number of steps made by the turning of the gear in moving the tray 6 to the loading position.

Each component will be described in detail later.

As shown in FIG. 4, the tray 6 of the present embodiment is constituted by two trays, namely a first tray 61 and a second tray 62. In the automatic mode, the first tray 61 and the second tray 62 are moved (expanded) in correspondence with two sizes of paper, namely the A4 size and the A3 size. As shown in FIG. 4, when in the stowage position, the tray 6 is stowed in a stacked state where the second tray 62 is located in a higher position and the first tray 61 is located in a lower position.

In moving the tray 6 from the stowage position to the loading position in the automatic mode, the present embodiment moves the first tray 61 in the direction of ejection D2 first and then, after the first tray 61 has moved to a maximum extent, moves the second tray 62. Accordingly, when the tray 6 has moved to the loading position, the first tray 61 is located downstream of the second tray 62 in the direction of ejection D2 as shown in FIG. 2. In other words, the second tray 62 is located upstream of the first tray 61 in the direction of ejection D2 of the sheet of paper S in the loading position.

Further, the automatic mode is configured such that a movement to loading positions associated with two sizes of paper, namely the A4 size and the A3 size, is enabled by moving the first tray 61 to a maximum extend first and then varying the amount of movement of the second tray 62 according to the size of a sheet of paper S.

As will be described in detail later, in moving the tray 6 from the stowage position to the loading position in the manual mode, the user draws out (moves) the first tray 61 from the housing 200 by grasping an outer apical end of the first tray 61 and drawing out the first tray 61 in the direction of ejection D2 first. When the first tray 61 has been drawn out to the maximum extent, continuing to draw out the first tray 61 leads to engagement of engagement sections (not illustrated) that are formed in the first tray 61 and the second tray 62, whereby the second tray 62 is drawn out in tandem with the first tray 61. In the manual mode, the user can adjust the tray 6 by drawing out the tray 6 to the desired loading position.

Further, as will be described in detail later, in moving from the loading position to the stowage position in the automatic mode, the second tray 62 is moved in a direction opposite to the direction of ejection D2 first, and then after the second tray 62 has moved to the stowage position, the first tray 61 is moved to the stowage position. In moving from the loading position to the stowage position in the manual mode, the user grasps the first tray 61 and pushes in (moves) the first tray 61 in a direction opposite to the direction of ejection D2. When the first tray 61 has been pushed in to a maximum extent, continuing to pushing in the first tray 61 leads to contact of the second tray 62 with a contact portion (not illustrated) formed in the first tray 61, whereby the first tray 61 and the second tray 62 are pushed in.

Figure 5:
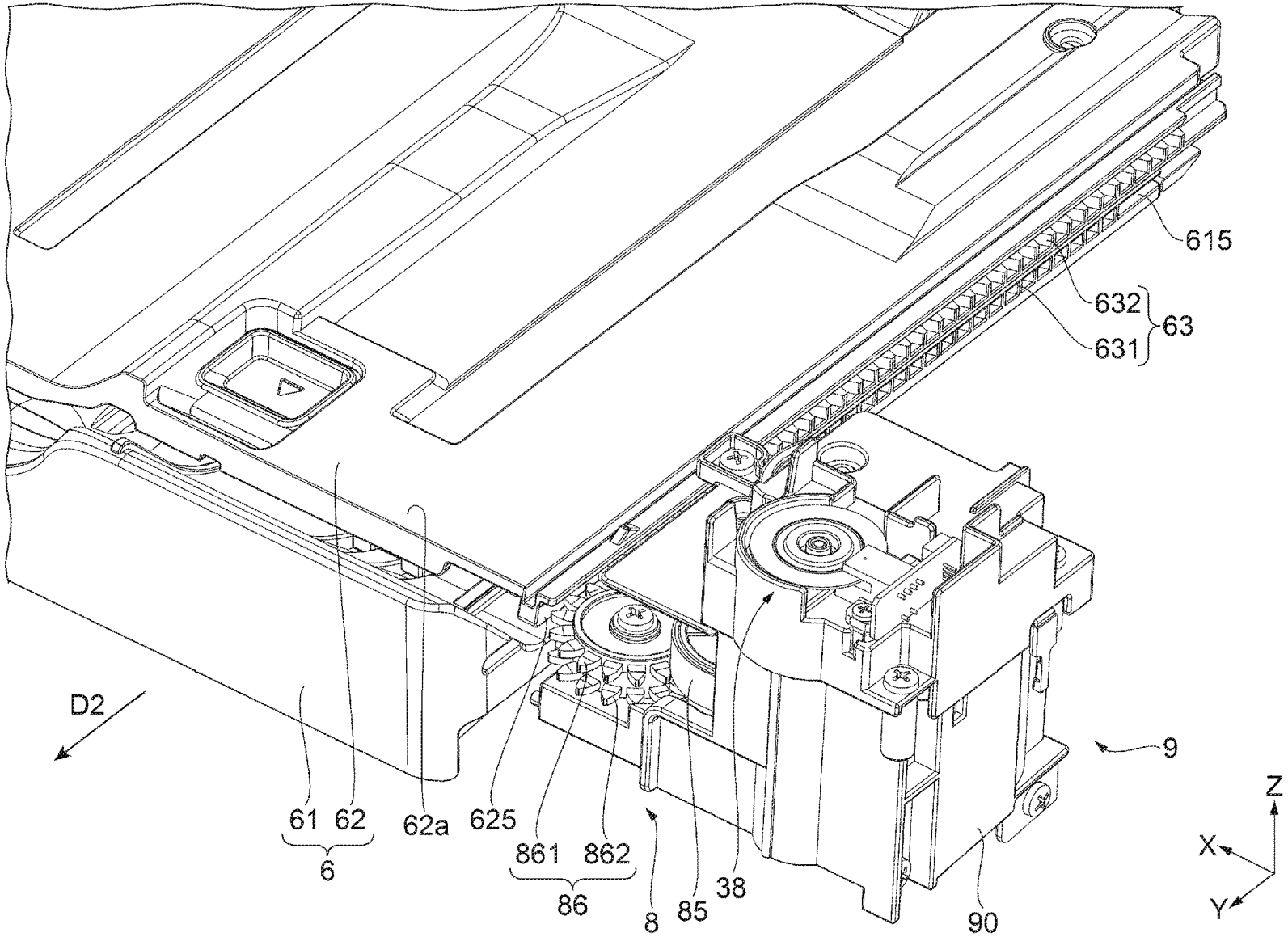
FIG. 5 is a perspective view showing a state of a gear train mechanism in the stowage position of the tray.
Figure 6:
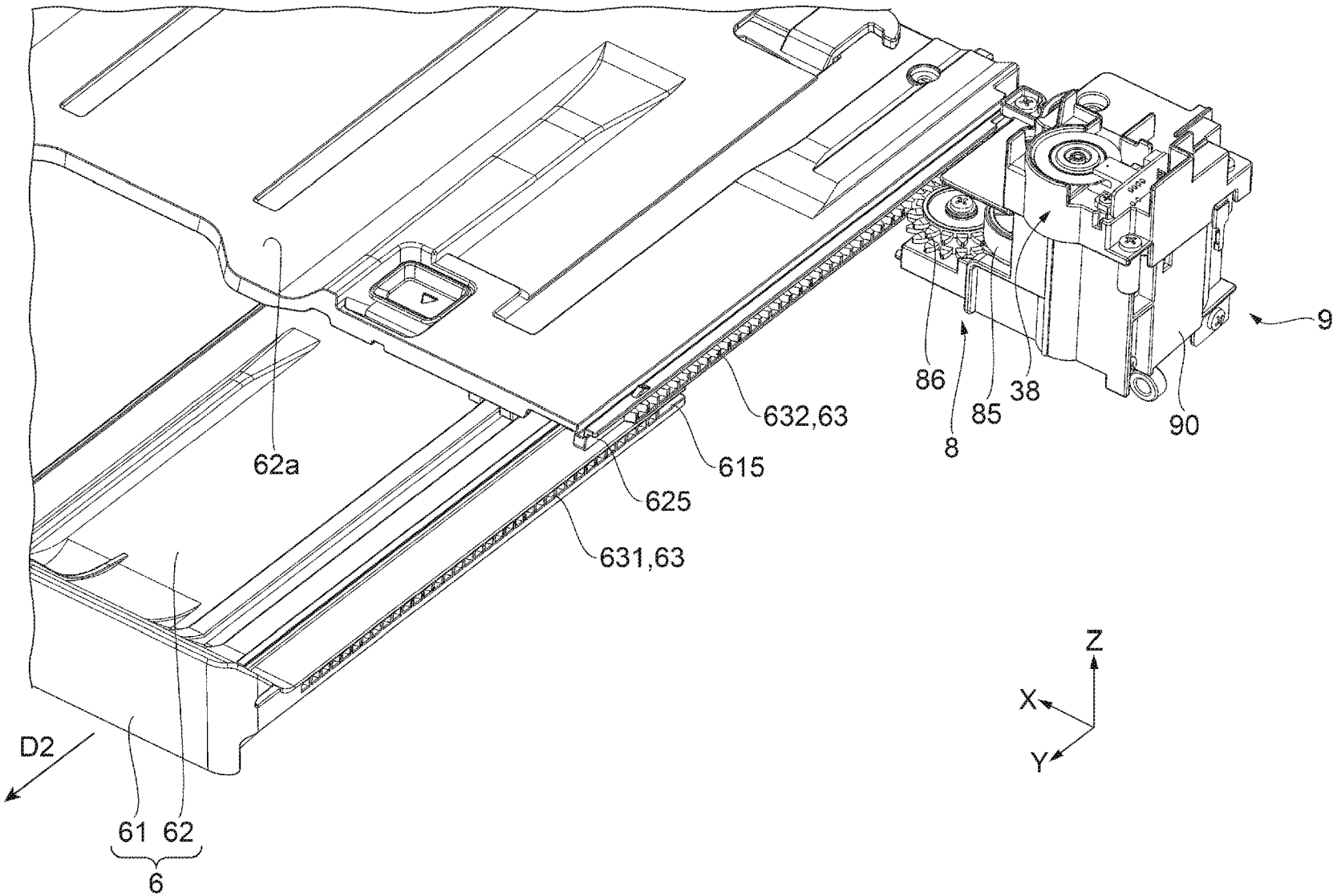
FIG. 6 is a perspective view showing a state where the tray has moved to a loading position in which to mount an A3-size sheet of paper.

FIG. 5 is a perspective view showing a state of the gear train mechanism 8 in the stowage position of the tray 6. FIG. 6 is a perspective view showing a state where the tray 6 has moved to a loading position in which to mount an A3-size sheet of paper S. It should be noted that FIGS. 5 and 6 also illustrate the second detection section 38 in addition to the gear train mechanism 8.

As shown in FIGS. 5 and 6, the gear train mechanism 8 is combined with the driving source 7 (see FIG. 7) and the second detection section 38 to constitute a gear train unit 9. In particular, the gear train mechanism 8 is constituted by the after-mentioned gears that function as the gear train mechanism 8 by being fixedly assembled in predetermined positions based on a unit case 90. Further, the gear train unit 9 is constituted by the driving source 7 and the second detection section 38 being assembled based on the unit case 90.

As shown in FIG. 4, the rack 63 is formed in a right-hand surface of the tray 6. The rack 63 has a first rack 631 formed over substantially the whole right-hand surface of the first tray 61. Further, the rack 63 has a second rack 632 formed over substantially the whole right-hand surface of the second tray 62. The first rack 632 and the second rack 632 are both formed with their tooth tips facing rightward. Further, the first rack 631 and the second rack 632 both have their teeth formed at the same pitches.

In particular, as shown in FIG. 4, the rack 63 is formed such that the first tooth in the front of the second rack 632 corresponds to the second or subsequent tooth as counted from the front of the first rack 631. The second rack 632 has a groove 625 formed in front of the first teeth of the second rack 632.

As shown in FIG. 5, the gear train unit 9 is placed on the right side of the tray 6 and the front of the housing 200. Further, the gear train mechanism 8 has a sixth gear 86 in meshing engagement with the rack 63 of the train 6. The sixth gear 86 is configured as the after-mentioned pinion.

Specifically, the sixth gear 86 includes a sixth gear A 861 and a sixth gear B 862 that share the same center, that vertically overlap each other, and that are both configured to be the same in pitch and diameter as each other. The sixth gear A 861, which serves as an upper side, meshes with the second rack 632, and the sixth gear B 862, which serves as a lower side, meshes with the first rack 631.

When the tray 6 is in the stowage position, the sixth gear B 862 meshes with the first rack 631, but the sixth gear A 861 does not mesh with the second rack 632, as the sixth gear A 861 has its tooth tips located in the groove 625 in the front of the second rack 632.

Figure 7:
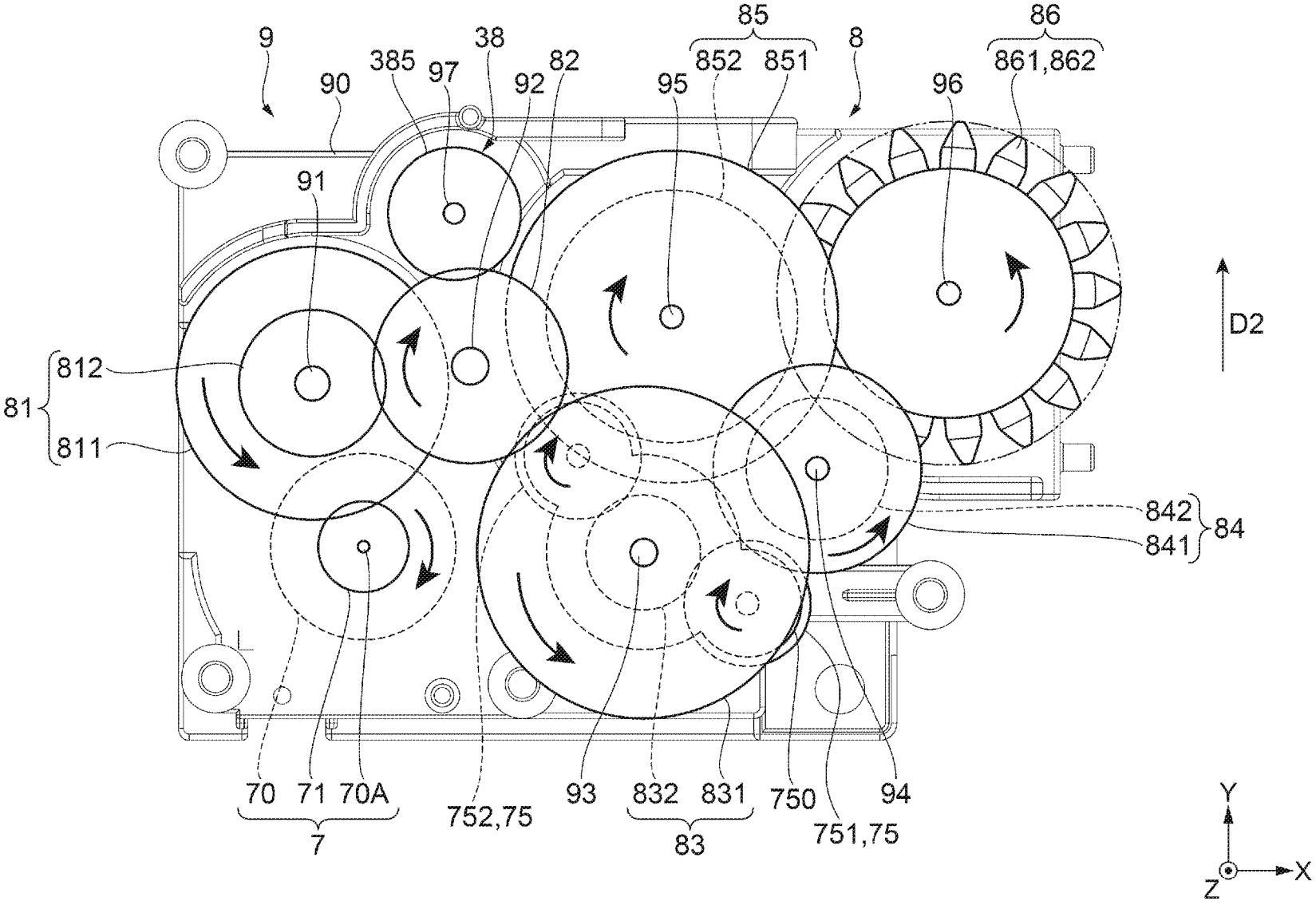
FIG. 7 is a plan view showing a state of the gear train mechanism in a case where the tray moves from the stowage position to the loading position in an automatic mode.
Figure 8:
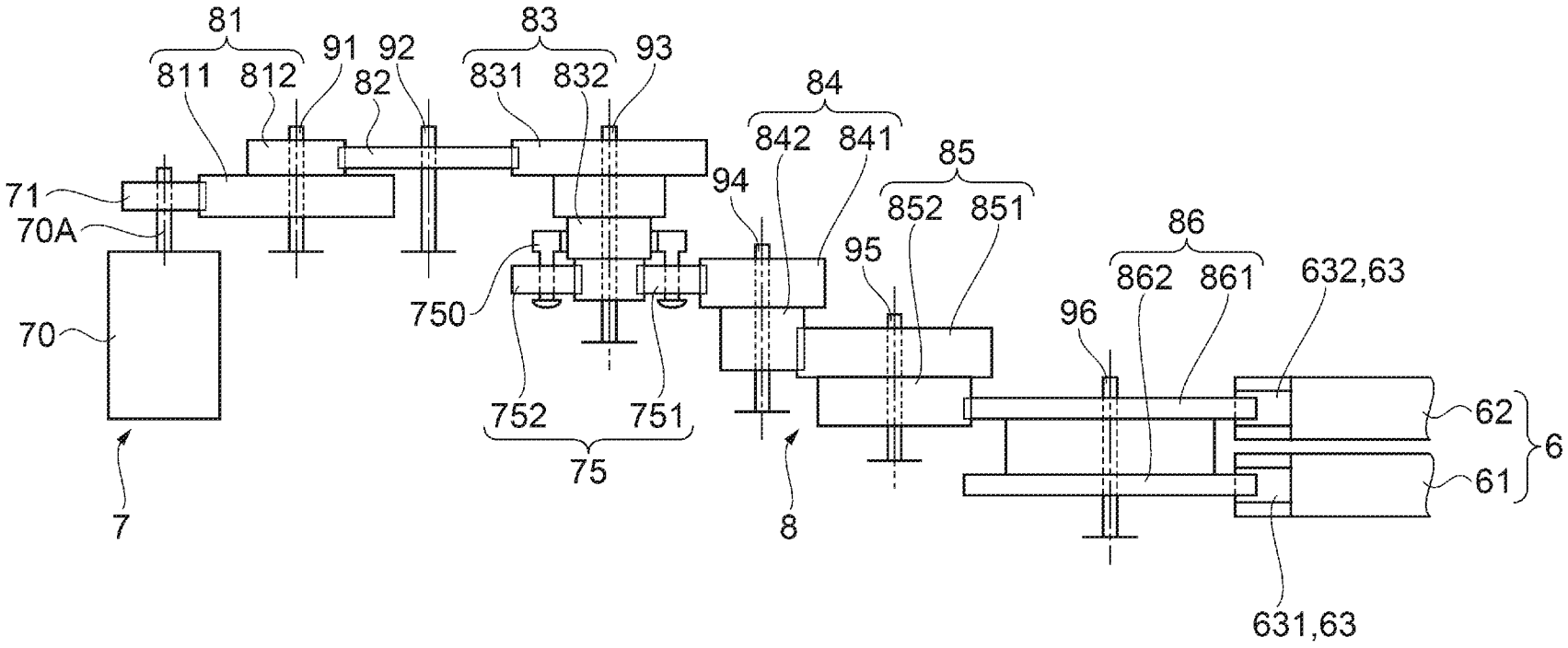
FIG. 8 is a sectional side view schematically developing a configuration of a driving source and the gear train mechanism.

FIG. 7 is a plan view showing a state of the gear train mechanism 8 in a case where the tray 6 moves from the stowage position to the loading position in the automatic mode. It should be noted that FIG. 7 illustrates only a gear 385 in the second detection section 38. Further, FIG. 7 indicates the direction of turning of each gear with an arrow. FIG. 8 is a sectional side view schematically developing a configuration of the driving source 7 and the gear train mechanism 8. FIG. 8 shows a state where a first planet gear 751 and a fourth gear A 841 are in meshing engagement with each other in the automatic mode. Further, FIG. 8 shows a state where the sixth gear 86 is in meshing engagement with the rack 63.

First, the configuration of the driving source 7 and the gear train mechanism 8 is described.

In the unit case 90 of the gear train unit 9, turning shafts 91 to 97 that pivotally support their corresponding gears so that the gears can turn are provided to stand, and the gears are placed on these turning shafts 91 to 97.

The gear train mechanism 8 is constituted by a first gear 81, the second gear 82, a third gear 83, a planet gear 75, a fourth gear 84, a fifth gear 85, and the sixth gear 86.

In the unit case 90, the driving motor 70, which serves as the driving source 7, is placed with its driving shaft 70A facing upward. A motor-side gear 71 is fixed to the driving shaft 70A of the driving motor 70. Turning of the driving motor 70 causes the motor-side gear 71 to turn together.

The first gear 81 is a gear that meshes with the motor-side gear 71 and the second gear 82. The first gear 81 is centered at the turning shaft 91, has its lower side constituted by a first gear A 811 that meshes with the motor-side gear 71, and has its upper side constituted by a first gear B 812 that meshes with the second gear 82. The first gear B 812 is configured to be smaller in diameter than the first gear A 811. Further, the motor-side gear 71 and the first gear A 811 are formed by helical gears. The first gear B 812 is constituted by a spur gear.

The second gear 82 is a gear that meshes with the first gear 81 and the third gear 83. The second gear 82 is constituted by one gear, and is placed so as to be able to turn around the turning shaft 92.

The third gear 83 is a gear that meshes with the second gear 82 and the plant gear 75. The third gear 83 is centered at the turning shaft 93, has its upper side constituted by a third gear A 831 that meshes with the second gear 82, and has its lower side constituted by a third gear B 832 that meshes with the planet gear 75. The third gear B 832 of the third gear 83 is configured as a so-called sun gear.

The planet gear 75 is constituted by two gears, namely the first planet gear 751 and a second planet gear 752. The planet gear 75 is centered at the third gear B 832, which serves as a sun gear, turns (rotates) in meshing engagement with the third gear B 832, and moves (revolves) in the direction of turning of the third gear B 832. In other words, the two planet gears 75 (namely the first plant gear 751 and the second planet gear 752) revolve while rotating on the third gear B 832, which serves as a sun gear.

As shown in FIGS. 7 and 8, the first plant gear 751 and the second planet gear 752 are coupled to each other by a carrier 750. Therefore, the first plant gear 751 and the second planet gear 752 is fixed in a relative position centered at the third gear B 832, rotate in meshing engagement with the third gear B 832, and revolve around the third gear B 832.

The fourth gear 84 is a gear that meshes wither either of the planet gears 75 and the fifth gear 85. Further, the fourth gear 84 and the planet gear 75 have a non-meshing state in accordance with an instruction from the control section 32. The fourth gear 84 is centered at the turning shaft 94, has its upper side constituted by a fourth gear A 841 that meshes with the planet gear 75, and has its lower side constituted by a fourth gear B 842 that meshes with the fifth gear 85. The fourth gear B 842 is configured to be smaller in diameter than the fourth gear A 841.

Figure 12:
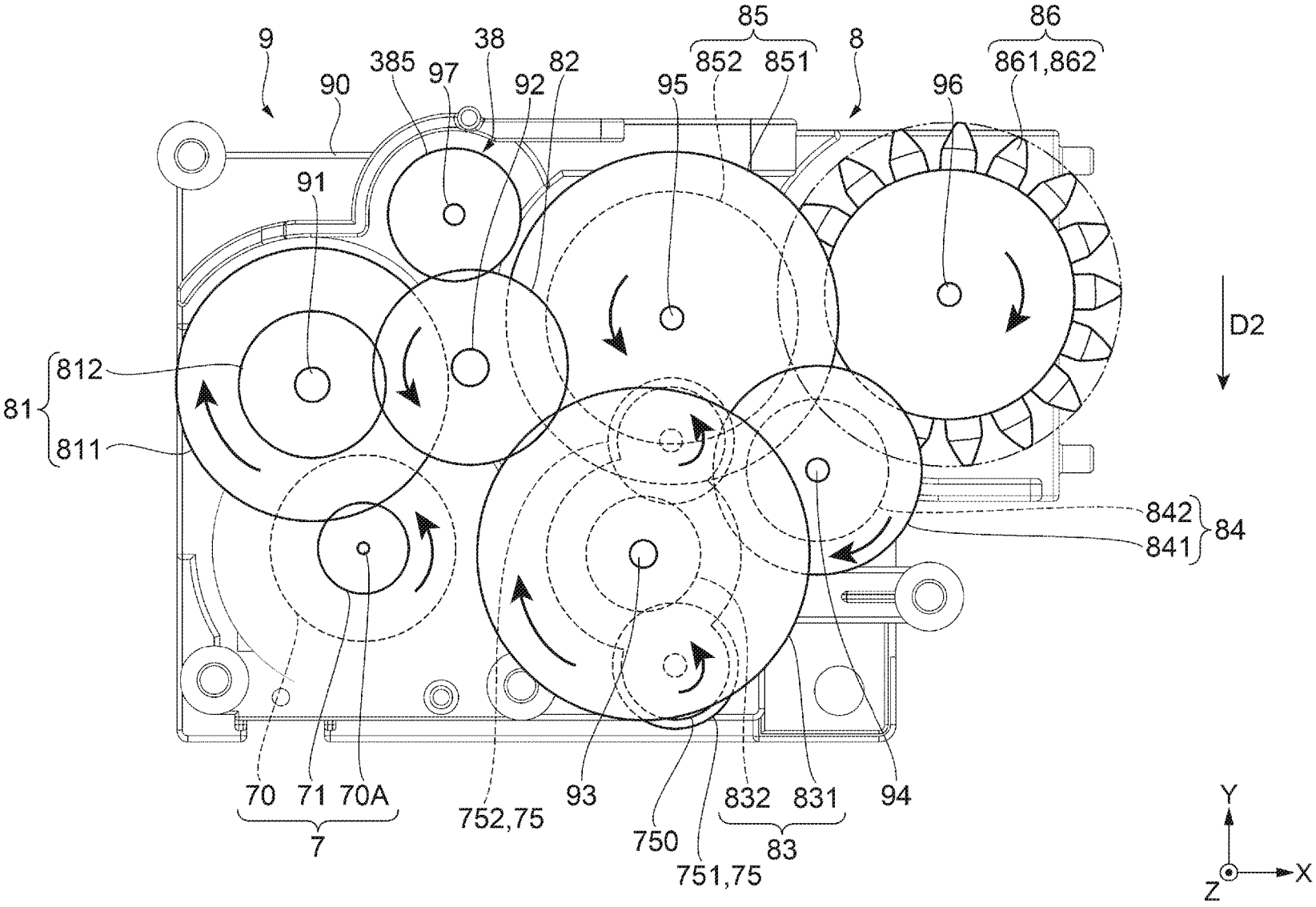
FIG. 12 is a plan view showing a state of the gear train mechanism in a case where the tray moves from the loading position to the stowage position in the automatic mode.
Figure 13:
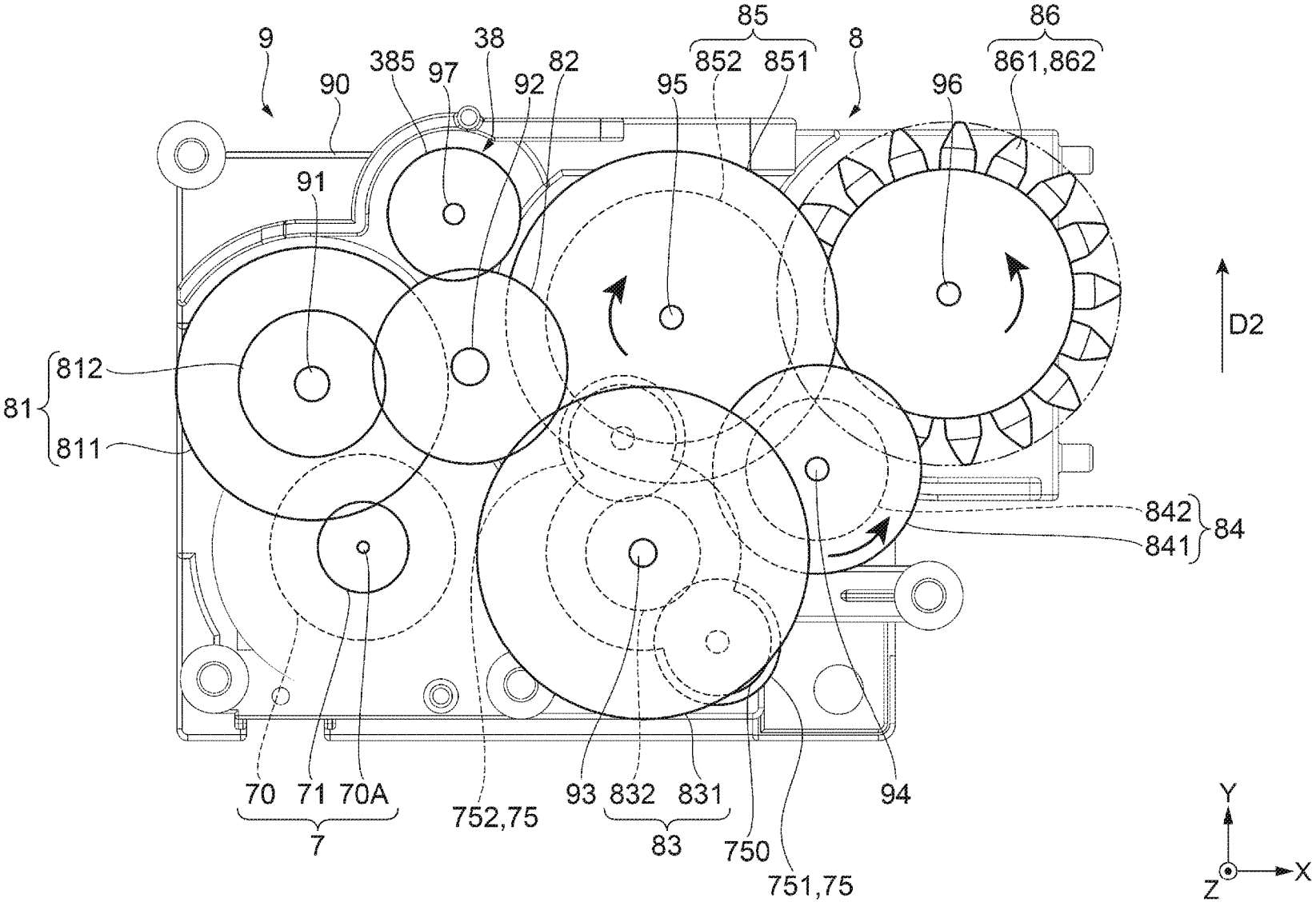
FIG. 13 is a plan view showing a state of the gear train mechanism in a case where the tray moves from the stowage position to the loading position in a manual mode.

In a state where the automatic mode has been selected, as shown in FIG. 7, the first planet gear 751 and the fourth gear A 841 are brought into meshing engagement with each other in moving the tray 6 to the loading position. Further, in a state where the automatic mode has been selected, as shown in FIG. 12 below, the second planet gear 752 and the fourth gear A 841 are brought into meshing engagement with each other in moving the tray 6 to the stowage position. Further, in a state where the manual mode has been selected, as shown in FIG. 13 below, the second planet gear 752 and the first planet gear 751 are both brought into a non-meshing state out of meshing engagement with the fourth gear A 841.

The fifth gear 85 is a gear that meshes with the fourth gear 84 and the sixth gear 86. The fifth gear 85 is centered at the turning shaft 95, has its upper side constituted by a fifth gear A 851 that meshes with the fourth gear B 842, and has its lower side constituted by a fifth gear B 852 that meshes with the sixth gear 86. The fifth gear B 852 is configured to be smaller in diameter than the fifth gear A 851.

The sixth gear 86 is a gear that functions as a pinion and that meshes with the fifth gear 85 and the rack 63. The sixth gear 86 is centered at the turning shaft 96, has its upper side constituted by the sixth gear A 861, which meshes with the fifth gear B 852, and has its lower side constituted by the sixth gear B 862. The sixth gear A 861, which functions as a pinion, meshes with the second rack 632 formed in the second tray 62. Further, the sixth gear B 862, which functions as a pinion, meshes with the first rack 631 formed in the first tray 61.

The plant gear 751 is configured between the driving source 7 and the fourth gear A 841. Further, the fourth gear A 841 is configured as a gear that transmits and receives motive power to and from the sixth gear 86 (pinion).

Next, the motion of the driving source 7 and the gear train mechanism 8 in a case where the tray 6 is moved from the stowage position to the loading position in the automatic mode is described.

As shown in FIGS. 7 and 8, in moving the tray 6 to the loading position in the automatic mode, the driving motor 70 starts turning in one direction in accordance with an instruction from the control section 32. In the present embodiment, the driving motor 70 turns clockwise. Then, the turning (motive power) of the driving motor 70 is transmitted to the first gear A 811 of the first gear 81 via the motor-side gear 71. This transmission causes the first gear 81 to turn counterclockwise.

The turning (motive power) transmitted to the first gear 81 is transmitted to the second gear 82 via the first gear B 812. This transmission causes the second gear 82 to turn clockwise. The turning (motive power) transmitted to the second gear 82 is transmitted to the third gear A 831 of the third gear 83. This transmission causes the third gear 83 to turn counterclockwise.

The turning (motive power) transmitted to the third gear 83 is transmitted to the planet gear 75 via the third gear B 832. This transmission causes both the first and second planet gears 751 and 752 of the planet gear 75 to turn (rotate) clockwise together. In addition, the plant gear 75 turns (revolves) around the third gear B 832 counterclockwise in the direction of turning of the third gear B 832, which functions as a sun gear.

The movement of the planet gear 75 turning (revolving) counterclockwise brings the first planet gear 751 into meshing engagement with the fourth gear A 841 of the fourth gear 84, so that the motive power is transmitted to the fourth gear A 841. It should be noted that the second planet gear 752 only turns (rotates) in meshing engagement with the third gear B 832, and does not mesh with the other gears. This transmission causes the fourth gear 84 to turn counterclockwise.

The turning (motive power) transmitted to the fourth gear 84 is transmitted to the fifth gear A 851 of the fifth gear 85 via the fourth gear B 842. This transmission causes the fifth gear 85 to turn clockwise.

The turning (motive power) transmitted to the fifth gear 85 is transmitted to the sixth gear A 861 of the sixth gear 86 via the fifth gear B 852. This transmission causes both the sixth gears A 861 and B 862 of the sixth gear 86, which serves as a pinion, to turn counterclockwise together. The sixth gear 86, by turning counterclockwise, moves the tray 6 in the direction of ejection D2 via the rack 63, with which the sixth gear 86 meshes.

The motion of the sixth gear 86 and the rack 63 in a case where the tray 6 is moved from the stowage position to the loading position in the automatic mode is described here with reference to FIGS. 4 to 6.

As shown in FIG. 5, when the tray 6 is located in the stowage position, the sixth gear B 862 is in a state of meshing with the first rack 631. Further, the sixth gear A 861 is located in the groove 625 in the front of the second rack 632 and is in a state of not meshing with the second rack 632.

In this state, the driving motor 70 starts driving in accordance with an instruction from the control section 32 to turn clockwise, whereby as mentioned above, the motive power is finally transmitted to the sixth gear 86 to cause the sixth gear 86 to turn counterclockwise. In that case, since the sixth gear B 862 is in meshing engagement with the first rack 631, the first tray 61, which forms the first rack 631, starts moving in the direction of ejection D2.

As shown in FIG. 6, a groove 615 is formed on a rear side of the first rack 631 opposite to the direction of ejection D2. In a state where the first rack 631, which meshes with the sixth gear B 862, has moved to a maximum extent in the direction of ejection D2, a plurality of teeth of the first rack 631 in front of the groove 615 and the teeth of the second rack 632 formed behind the groove 625 overlap in plan view. FIG. 8 cross-sectionally illustrates a state of the sixth gear 86 and the rack 63 in a state where the first rack 631 and the second rack 632 overlap in plan view.

With this configuration, when the first rack 631, which meshes with the sixth gear B 632, has moved to the maximum extent in the direction of ejection D2, the sixth gear A 861 and the second rack 632 are brought into meshing engagement with each other. Since the second rack 632 meshes with the sixth gear A 861, the second tray 62, which forms the second rack 632, starts moving in the direction of ejection D2. Further, at the same time, since the sixth gear B 862 is located in the groove 615, the motive power is not transmitted to the first rack 631.

Accordingly, while the first tray 61 retains a state of having moved to a maximum extent in the direction of ejection D2 with respect to the second tray 62, the second tray 62 moves in the direction of ejection D2. When the second tray 62 moves in the direction of ejection D2, the amount of movement of the second tray 62 is set in accordance with the size (A4 size or A3 size) of a sheet of paper S to be subjected to printing.

Figure 9:
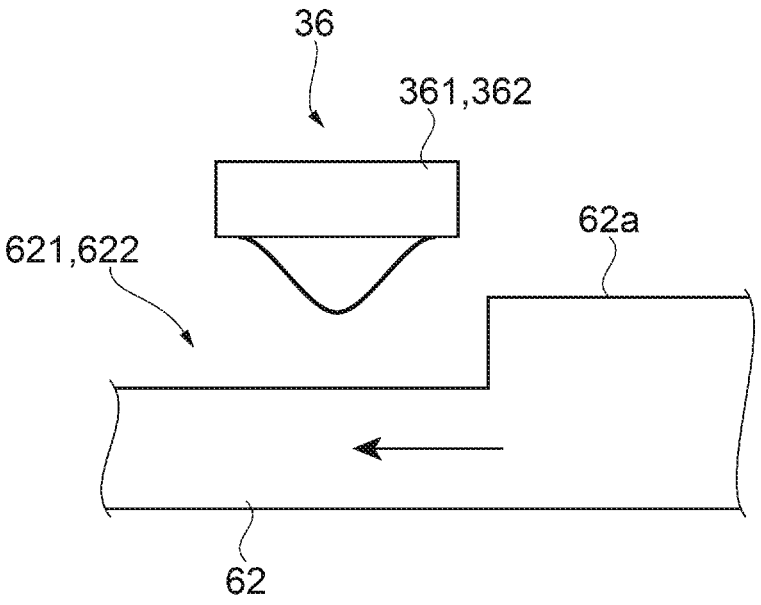
FIG. 9 is a schematic cross-sectional view explaining a detecting operation of a first detection section.
Figure 10:
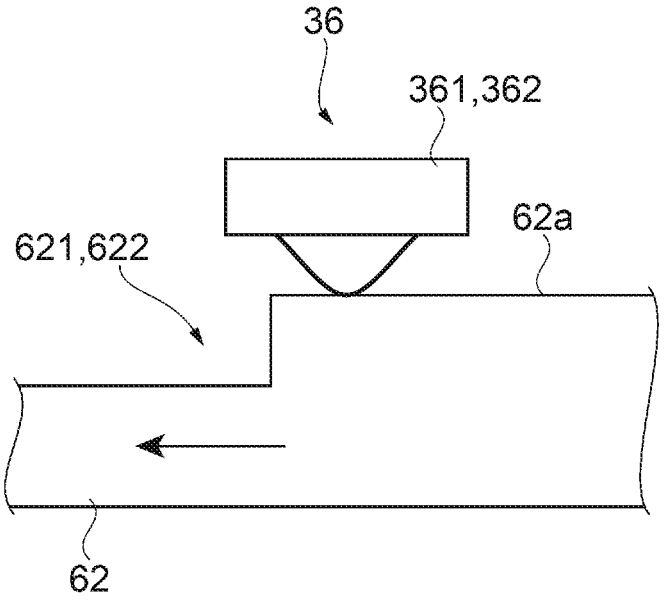
FIG. 10 is a schematic cross-sectional view explaining the detecting operation of the first detection section.

FIGS. 9 and 10 are each a schematic cross-sectional view explaining a detecting operation of the first detection section 36. FIG. 9 shows a state where the first detection section 36 is "OFF", and FIG. 10 shows a state where the first detection section 36 is "ON".

The first detection section 36 and components therearound are described.

The second tray 62 has formed in a mounting surface 62*a* thereof an A4 detection auxiliary section 621 and an A3 detection auxiliary section 622, formed by recesses or projections, that serve to detect arrival of the tray 6 at loading positions for use in A4 size and A3 size, respectively. In the present embodiment, the A4 detection auxiliary section 621 and the A3 detection auxiliary section 622 are formed by recesses.

Moreover, the first detection section 36 is constituted by an A4 detection section 361, placed above the A4 detection auxiliary section 621, that corresponds to the A4 detection auxiliary section 621. Further, the first detection section 36 is constituted by an A3 detection section 362, placed above the A3 detection auxiliary section 622, that corresponds to the A3 detection auxiliary section 622. As mentioned above, the first detection section 36 is constituted by a mechanical switch.

As shown in FIG. 10, when the tray 6 has arrived at the loading position for use in A4 size, the A4 detection section 361 detects a change in height from the recess to the mounting surface 62*a* in the A4 detection auxiliary section 621 and, for example, outputs a change from "OFF" to "ON" to the control section 32. Similarly, when the tray 6 has arrived at the loading position for use in A3 size, the A3 detection section 362 detects a change in height from the recess to the mounting surface 62*a* in the A3 detection auxiliary section 622 and, for example, outputs a change from "OFF" to "ON" to the control section 32.

In response to the change in a signal from the first detection section 36 from "OFF" to "ON", the control section 32 determines that the tray 6 has moved to the loading position that corresponds to the paper size, and instructs the driving motor 70 to stop driving.

Figure 11:
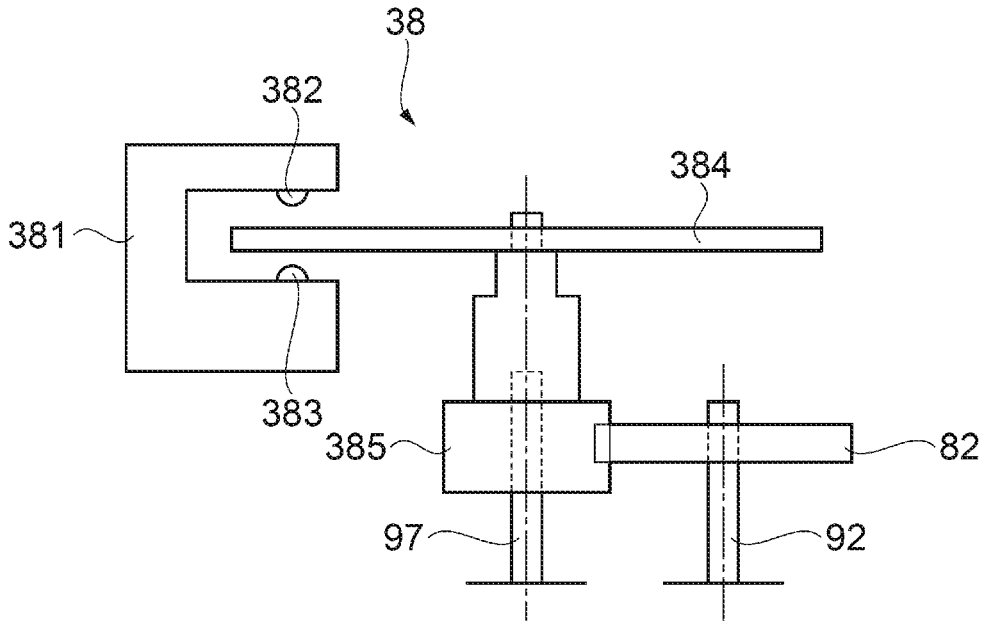
FIG. 11 is a schematic cross-sectional view explaining a configuration and operation of a second detection section.

FIG. 11 is a schematic cross-sectional view explaining a configuration and operation of the second detection section 38.

The second detection section 38 is described.

As shown in FIG. 11, the second detection section 38 is constituted by an incremental rotary encode. The second detection section 38 has an encoder body 381 including an light-emitting section 382 including a light-emitting diode that emits infrared light and a light-receiving section 383 including a photodiode or a phototransistor. Further, the second detection section 38 includes a transparent disk 384 around the outer periphery of which components (not illustrated) for effecting turning on or turning off by transmitting or not transmitting light are formed at equal spacings.

The light-emitting section 382 and the light-receiving section 383 are placed vertically opposite each other across the components formed around the outer periphery of the disk 384. Further, the second detection section 38 includes the gear 385, which shares the same center with the disk 384, and the gear 385 is placed so as to be able to turn around the turning shaft 97. The disk 384 turns together along with the turning of the gear 385.

In the present embodiment, the gear 385 of the second detection section 38 is in meshing engagement with the second gear 82 of the gear train mechanism 8. Accordingly, the turning of the second gear 82 is transmitted to the gear 385, so that the gear 385 turns. The second detection section 38 detects "ON" or "OFF" through turning of the disk 384 driven by the turning of the gear 385. The output waveform of light that is received by the second detection section 38 is a pseudo-sine wave that is close to a triangular wave, and is therefore subjected to waveform shaping by a subsequent amplifier to be converted into a rectangular wave signal. Further, the second detection section 38 includes a counter (not illustrated) that counts a turning angle (turning displacement) as the number of steps.

The second detection section 38 also functions in moving the tray 6 to a loading position. In particular, the control section 32 reads, from the storage section 34, the number of steps it takes for the tray 6 to arrive at each loading position. The number of steps thus read is set larger than the number of steps needed to actually arrive at the loading position.

Basically, it is the first detection section 36 that detects arrival of the tray 6 at a loading position. However, for example, when the first detection section 36 fails to function or in other cases, the control section 32 uses the second detection section 38 to determine whether the set number of steps has been reached and, when the number of steps has been reached, stops the movement of the tray 6 by causing the driving motor 70 to stop turning. In this way, the second detection section 38 also functions as a detection section that complements the first detection section 36.

When the tray 6 has moved to and stopped at the predetermined loading position in the automatic mode, the control section 32 then brings the first planet gear 751 and the fourth gear A 841 out of meshing engagement with each other into the non-meshing state. As will be mentioned later, the same applies to a case where the tray 6 has moved to and stopped at the predetermined stowage position in the automatic mode. After the tray 6 has moved to the stowage position, the second planet gear 752 and the fourth gear A 841 are brought out of meshing engagement with each other into the non-meshing state.

Thus, in the present embodiment, the planet gear 75 and the fourth gear 84 (fourth gear A 841) are brought out of meshing engagement with each other immediately after the tray 6 has moved to the loading position or the stowage position in the automatic mode. In the present embodiment, the position that the planet gear 75 assumes when the planet gear 75 is in a non-meshing state of not meshing with the fourth gear 84 is referred to as "retreat position".

In order to bring the first planet gear 751 and the fourth gear A 841 into the non-meshing state, the control section 32 instructs the driving motor 70 to turn in a direction opposite to the direction in which the driving motor 70 turned in moving the tray 6 to the loading position. In this case, the driving motor 70 turns counterclockwise.

Note, however, that continuing to cause the driving motor 70 to turn counterclockwise brings the second planet gear 752 into meshing engagement with the fourth gear A 841, so that the tray 6 starts moving to the stowage position. Therefore, the control section 32 controls the turning of the driving motor 70 so that the first planet 751 and the fourth gear A 841 are brought out of meshing engagement with each other and the second planet gear 752 does not mesh with the fourth gear A 841.

In particular, the control section 32 reads, from the storage section 34, the number of steps in the second detection section 38 needed for the first planet gear 751 and the fourth gear A 841 to be brought out of meshing engagement with each other and for the second planet gear 752 not to mesh with the fourth gear A 841. Then, the control section 32 causes the driving motor 70 to turn counterclockwise. Further, the second detection section 38 counts the number of steps made by the turning of the disk 384. Then, when the predetermined number of steps has been reached, the control section 32 causes the driving motor 70 to stop turning.

In this way, the motion of the driving source 7 and the train gear mechanism 8, including the control section 32, makes it possible to bring the first planet gear 751 and the fourth gear A 841 out of meshing engagement with each other and bring the second planet gear 752 into a state of not meshing with the fourth gear A 841. Bringing the planet gear 75 into the non-meshing state of not meshing with the fourth gear 84 makes it possible to protect the gear train mechanism 8 and the driving source 7 when the user has then manually moved the tray 6 from the loading position or in other cases.

In particular, when the tray 6 has been manually moved, for example, in a direction toward the stowage position, the movement of the tray 6 causes the sixth gear 86 to turn, and the turning of the sixth gear 86 is transmitted to the fourth gear 84 via the fifth gear 85. However, since the fourth gear 84 and the planet gear 75 are in the non-meshing state, the turning of the fourth gear 84 caused by the movement of the tray 6 is not transmitted to the planet gear 75. Therefore, the third gear 83, the second gear 82, the first gear 81, and the driving motor 70 do not turn. This makes it possible to prevent malfunctions such as damage to a gear in the gear train mechanism 8 and generation of a counter electromotive force of the driving motor 70.

When the tray 6 has moved, for example, to the loading position corresponding to the A4 size, the turning of the fourth gear 84 caused by the movement of the tray 6 is similarly not transmitted to the planet gear 75, even in a case in which the user has further moved the tray 6 in the direction of ejection D2 to the loading position corresponding to the A3 size.

FIG. 12 is a plan view showing a state of the gear train mechanism 8 in a case where the tray 6 moves from the loading position to the stowage position in the automatic mode.

An operation in which the tray 6 moves from the loading position to the stowage position in the automatic mode is described. It should be noted that FIG. 12 indicates the direction of turning of each gear with an arrow.

In order to cause the tray 6 to move from the loading position to the stowage position, the control section 32 instructs the driving motor 70 to turn in a direction opposite (in the present embodiment, counterclockwise) to the direction in which the driving motor 70 turned in moving the tray 60 to the loading position.

When the driving motor 70 has turned counterclockwise, the first gear 81, the second gear 82, and the third gear 83 are in the same meshing engagement with one another as they were in moving the tray 6 to the loading position but turn in directions opposite to the directions in which they turned in moving the tray 6 to the loading position. Moreover, when the turning (motive power) is transmitted to the third gear 83, which meshes with the second gear 82, the third gear A 831 turns clockwise.

The turning (motive power) transmitted to the third gear A 831 is transmitted to the planet gear 75 via the third gear B 832. This transmission causes both the first and second planet gears 751 and 752 of the planet gear 75 to turn (rotate) counterclockwise together. In addition, the planet gear 75 turns (revolves) clockwise in the direction of turning of the third gear 83 (third gear B 832), which serves as a sun gear.

The movement of the planet gear 75 turning (revolving) clockwise brings the second planet gear 752 into meshing engagement with the fourth gear A 841, so that the motive power is transmitted to the fourth gear A 841. It should be noted that the first planet gear 751 only turns (rotates) in meshing engagement with the third gear B 832, and does not mesh with the other gears. This transmission causes the fourth gear 84 to turn clockwise.

The fourth gear 84, the fifth gear 85, and the sixth gear 86 are in the same meshing engagement with one another as they were in moving the tray 6 to the loading position. Moreover, when the turning (motive power) transmitted to the fourth gear 84 has been transmitted to the sixth gear 86, the sixth gear 86 turns clockwise.

As shown in FIG. 6, in the loading position, the sixth gear A 861 is in meshing engagement with the second rack 632 of the second tray 62, which serves as an upper tray of the tray 6. Further, the sixth gear B 862 is out of meshing engagement with the first rack 631 of the first tray 61, which serves as a lower tray of the tray 6. Therefore, the sixth gear A 861, which turns clockwise, causes the second rack 632, with which the sixth gear A 861 meshes, to start moving in a direction toward the stowage position opposite to the direction of ejection D2. This causes the second tray 62 to start moving in a direction toward the stowage position. The first tray 61 moves by being driven by the movement of the second tray 62.

When the sixth gear A 861 is located in the groove 625 of the second tray 62, the sixth gear B 862 is brought into meshing engagement with the first rack 631. Therefore, the turning of the sixth gear B 862 causes the first rack 631 to start moving in a direction toward the stowage position. This causes the first tray 61 to start moving in a direction toward the stowage position.

The second tray 62 is in a state of having moved to the stowage position as the second tray 62 immediately before the first tray 61 starts moving in a direction toward the stowage position. Therefore, the second tray 62 stops subsequent movements.

As shown in FIGS. 4 and 5, when continuation of the turning of the sixth gear B 862 has brought the sixth gear B 862 into meshing engagement with the front teeth of the first rack 631, the controller 32 instructs the driving motor 70 to stop driving. In particular, in the present embodiment, when the sixth gear B 862 has been brought into meshing engagement with the front teeth of the first rack 631, the first tray 61 is brought into contact with a first tray contact portion (not illustrated) placed inside the housing 200.

The contact of the first tray 61 with the first tray contact portion is detected by the control section 32 in accordance with a threshold overcurrent that is applied to the driving motor 70. In the case of an overcurrent exceeding the threshold, the control section 32 determines that the tray 6 has moved to the stowage position, and instructs the driving motor 70 to stop driving. This operation allows the tray 6 to move to the stowage position.

When the tray 6 has moved to and stopped at the predetermined stowage position in the automatic mode, the control section 32 then brings the second planet gear 752 and the fourth gear A 841 out of meshing engagement with each other into the non-meshing state.

In particular, the control section 32 reads, from the storage section 34, the number of steps in the second detection section 38 needed for the second planet gear 752 and the fourth gear A 841 to be brought out of meshing engagement with each other and for the first planet gear 751 not to mesh with the fourth gear A 841. Then, the control section 32 instructs the driving motor 70 to turn in a direction opposite to the direction in which the driving motor 70 turned in moving the tray 6 to the stowage position. In this case, the driving motor 70 turns clockwise.

Further, the second detection section 38 counts the number of steps made by the turning of the disk 384. Then, when the predetermined number of steps has been reached, the control section 32 causes the driving motor 70 to stop turning. This operation makes it possible to bring the second planet gear 752 and the fourth gear A 841 out of meshing engagement with each other and bring the first planet gear 751 into a state of not meshing with the fourth gear A 841.

FIG. 13 is a plan view showing a state of the gear train mechanism 8 in a case where the tray 6 moves from the stowage position to the loading position in the manual mode. An operation in which the user moves the tray 6 from the stowage position to the desired loading position in the manual mode is described. When the user has moved the tray 6 to the desired position, the tray 6 stops at that position.

In particular, the user grasps the first tray 61 and draws out the first tray 61 in the direction of ejection D2 from the tray 6 being stowed. This action causes the first tray 61 to start moving in the direction of ejection D2. The movement of the first tray 61 causes the first rack 631 to move, too. Along with the movement of the first rack 631 in the direction of ejection D2, the sixth gear 86 (sixth gear B 862) of the gear train mechanism 8 turns counterclockwise.

Then, the turning of the sixth gear 86 (sixth gear A 861) causes the fifth gear 85 (fifth gear B 852) to turn clockwise. Then, the turning of the fifth gear 85 (fifth gear A 851) causes the fourth gear 84 (fourth gear B 842) to turn counterclockwise.

However, even when the fourth gear 84 (fourth gear B 842) is turning counterclockwise, the turning is not transmitted to the planet gear 75, as the planet gear 75 is out of meshing engagement with the fourth gear 84 (fourth gear A 841). Accordingly, the turning is not transmitted to the third gear 83, the second gear 82, the first gear 81, and the driving source 7, which are configured subsequent to the planet gear 75.

When the user continues to draw out the first tray 61 after having drawn it out to a maximum extent, the second tray 62 is drawn out subsequent to the first tray 61. In this state, the second rack 632 formed in the second tray 62 causes the sixth gear A 861 of the sixth gear 86, with which the second rack 632 meshes, to turn counterclockwise. In this case, too, even when the fourth gear 84 (fourth gear B 842) is turning, the turning is not transmitted to the planet gear 75, as the planet gear 75 is out of meshing engagement with the fourth gear 84 (fourth gear A 841).

The tray 6 is fixed by the user stopping drawing it out at the desired appropriate position. In this case, the position of the tray 6 drawn out and stopped by the user is the loading position.

Next, an operation in which the tray 6 moves from the loading position to the stowage position in the manual mode is described. Assume that the manual mode has been selected by the user.

The user grasps the first tray 61 and pushes it in in a direction opposite to the direction of ejection D2 into the tray 6 located in the loading position. When the first tray 61 is grasped and moved from the loading position to the stowage position in the manual mode, the first tray 61 is pushed in in a direction opposite to the direction of ejection D2 first. Then, the second tray 62, together with the first tray 61, moves to the stowage position by being pushed in in a direction opposite to the direction of ejection D2.

When the tray 6 has been manually moved from the loading position to the stowage position, either the sixth gear B 862, which meshes with the first rack 631, or the sixth gear A 861, which meshes with the second rack 632, turns, and the turning is transmitted to the fourth gear 84. It should be noted that the direction of turning of each gear is opposite to the direction of turning shown in FIG. 13. In this case, too, even when the fourth gear 84 (fourth gear B 842) is turning, the turning is not transmitted to the planet gear 75, as the planet gear 75 is out of meshing engagement with the fourth gear 84 (fourth gear A 841).

For all of these reasons, when the tray 6 is moved to the loading position in the automatic mode, the planet gear 75 is moved to a position in which the first planet gear 751 is brought into meshing engagement with the fourth gear 84. Further, when the tray 6 is moved to the stowage position in the automatic mode, the planet gear 75 is moved to a position in which the second planet gear 752 is brought into meshing engagement with the fourth gear 84.

In the present embodiment, after the tray 6 has moved to the loading position or the stowage position in the automatic mode, the planet gear 75 is moved to the position (retreat position) in which the planet gear 75 does not mesh with the fourth gear 84. This is intended to handle a case where the manual mode has been selected or an unexpected manual movement of the tray 6. Therefore, the turning of the fourth gear 84 is not transmitted to the planet gear 75 not only when the tray 6 has been moved in the manual mode but also when the tray 6 has been unexpectedly manually moved.

In the automatic mode, the planet gear 75 has been moved to the position in which the planet gear 75 is brought into meshing engagement with the fourth gear 84. Further, in correspondence with the manual mode, the planet gear 75 has been moved to the position (retreat position) in which the planet gear 75 is not brought into meshing engagement with the fourth gear 84. In this way, the present embodiment switches between the automatic mode and the manual mode depending on the position of the planet gear 75.

The following describes a case where the tray 6 is manually moved to the loading position or the stowage position when electric power is no longer supplied to the recording apparatus 1, e.g. when a power cord has been pulled out or power has failed in the middle of a movement of the tray 6 to the loading position in the automatic mode or in the middle of a movement of the tray 6 to the stowage position in the automatic mode.

In such a case, either of the planet gears 75 and the fourth gear A 841 are in meshing engagement with each other, as the tray 6 is moving. Accordingly, when the tray 6 has been manually forced to move, the turning (motive power) is transmitted to the driving motor 70.

However, in the present embodiment, even in a state where the planet gear 75 and the fourth gear A 841 are in meshing engagement with each other, the characteristics of the planet gear 75 make it possible to bring it out of meshing engagement by repeatedly pushing and pulling the tray 6 with a little force, as the planet gear 75 is employed. This makes it possible to expand and contract the tray 6 and eliminate influence on the gear train mechanism 8 and the driving source 7 even when electric power is no longer supplied to the recording apparatus 1 in the middle of a movement of the tray 6.

The present embodiments bring about the following effects.

A recording apparatus 1 of the present embodiment includes a recording section 24, a tray 6, a control section 32, or other components. The tray 6 is movable to a loading position in which to load a sheet of paper S to be ejected and a stowage position in which the tray 6 is stowed in a housing 200. Moreover, the control section 32 switches between an automatic mode in which to automatically move the tray 6 to the loading position and the stowage position and a manual mode in which to manually move the tray 6 to the loading position and the stowage position.

In this way, since the control section 32 enables switching between the automatic mode in which to automatically perform an action of expanding and contracting the tray 6 and the manual mode in which to manually perform the action, a user can select between the automatic mode and the manual mode. This makes it possible to improve the convenience with which the tray 6 expands and contracts.

The recording apparatus 1 further includes a driving motor 70 serving as a driving source 7 and a gear train mechanism 8. The driving motor 70 drives the gear train mechanism 8. The gear train mechanism 8 moves the tray 6 to the loading position and the stowage position. Further, the gear train mechanism 8 has a planet gear 75. Moreover, switching between the automatic mode and the manual mode is done depending on the position of the planet gear 75.

This makes it possible to easily switch between the automatic mode and the manual mode and easily move the tray 6 to the loading position and the stowage position.

In the recording apparatus 1, the tray 6 has formed therein a rack 63 that meshes with the gear train mechanism 8. Further, the gear train mechanism 8 includes a sixth gear 86 serving as a pinion that meshes with the rack 63 and a fourth gear 84 serving as a gear that transmits and receive motive power to and from the sixth gear 86. The planet gear 75 is configured between the driving motor 70 and the fourth gear 84. Moreover, in the automatic mode, the planet gear 75 is brought into a meshing state of meshing with the fourth gear 84, and in the manual mode, the planet gear 75 is brought into a non-meshing state of not meshing with the fourth gear 84.

With this, in the automatic mode, the planet gear 75 is brought into the meshing state of meshing with the fourth gear 84; therefore, the motive power of the driving motor 70 is transmitted in the order of the planet gear 75, the fourth gear 84, the sixth gear 86, and the rack 63, whereby the tray 6 moves to the loading position and the stowage position. Further, in the manual mode, the planet gear 75 is brought into the non-meshing state of not meshing with the fourth gear 84; therefore, when the tray 6 has been manually moved to the loading position and the stowage position, motive power entailed by the movement of the tray 6 is transmitted in the order of the rack 63 and the fourth gear 84. However, since the planet gear 75 is brought into the non-meshing state of not meshing with the fourth gear 84, the motive power is not transmitted from the fourth gear 84 to the planet gear 75. This makes it possible to smoothly manually move the tray 6. Further, since the motive power entailed by the movement of the tray 6 is not transmitted to the driving motor 70, application of a load (counter electromotive force) to the driving motor 70 can be prevented.

In the recording apparatus 1, after the tray 6 moves to the loading position or the stowage position in the automatic mode, the motion of the driving motor 70 and the train gear mechanism 8 causes the planet gear 75 to move to a retreat position where the planet gear 75 is in the non-meshing state of not meshing with the fourth gear 84.

This makes it possible to smoothly move the tray 6 and prevent application of a load to the driving motor 70 even when the tray 6 has been intentionally or unexpectedly moved in the direction of ejection D2 or a direction toward the stowage position after the tray 6 has moved to the loading position or the stowage position, as the planet gear 75 has moved to the retreat position where the planet gear 75 is in the non-meshing state of not meshing with the fourth gear 84.

The recording apparatus 1 further includes an operation section 4 that inputs an instruction to the control section 32. Moreover, an instruction to switch between the automatic mode and the manual mode is inputted through the display panel 43 of the operation section 4. This allows the user to easily switch between the automatic mode and the manual mode.

In the recording apparatus 1, the tray 6 includes a first tray 61 and a second tray 62 located upstream of the first tray 61 in a direction of ejection D2 of the sheet of paper S in the loading position. Moreover, the second tray 62 is configured to be movable in the automatic mode to a loading position that corresponds to an A4-size sheet of paper S and a loading position that corresponds to an A3-size sheet of paper S. In the present embodiment, the tray 6 is moved to either the loading position for use in A4 size or the loading position for use in A3 size by moving the first tray 61 to a maximum extent first and then moving the second tray 62 to a corresponding one of the positions thus set.

This makes it possible to achieve a loading position corresponding to the size of the sheet of paper S and properly load the sheet of paper S to be ejected. Further, since the tray 6 can be moved to either the loading position for use in A4 size or the loading position for use in A3 size by adjusting only the second tray 62, the configuration of the tray 6 and the gear train mechanism 8 and the control of the control section 32 can be made easy.

2. Modification 1

The recording apparatus 1 of the present embodiment is configured such that a movement to loading positions corresponding to two sizes of paper, namely the A4 size and the A3 size, is enabled by moving the first tray 61 to a maximum extent first and then varying the amount of movement of the second tray 62 according to the size of a sheet of paper S. However, this is not intended to impose any limitation, and loading positions may be achieved by setting the amount of movement of the second tray 62 to three or more amounts of movement. This makes it possible to achieve loading positions corresponding to various sizes of paper, respectively.

3. Modification 2

The recording apparatus 1 of the present embodiment may also be configured such that when the current loading position is the loading position for use in A4 size and when an A3-size sheet of paper S is subjected to printing next, the control section 32 instructs the driving motor 70 to drive the gear train mechanism 8 to move the second tray 62 of the tray 6 toward the loading position for use in A3 size further in the direction of ejection D2. In this case, when an A4-size sheet of paper that was ejected has not been removed, the tray 6 is moved to the loading position for use in A3 size upon detection by the second detection section 38.

Further, on the other hand, when the current loading position is the loading position for use in A3 size and an A3-size sheet of paper S that was ejected has been removed and when an A4-size sheet of paper S is subjected to printing next, the control section 32 may instruct the driving motor 70 to drive the gear train mechanism 8 to move the second tray 62 of the tray 6 toward the loading position for use in A4 size in a direction opposite to the direction of ejection D2. In this case, the tray 6 may stay in the loading position for use in A3 size, as the A4-size sheet of paper S is smaller than the A3-size sheet of paper S.

As noted above, the convenience of the tray 6 in the automatic mode can be further improved by switching between the loading positions on an as-needed basis according to the size of the sheet of paper S to be ejected.

The following describes contents derived from the embodiments and the modifications.

According to an aspect of the present disclosure, there is provided a recording apparatus including: a recording section that performs recording on a medium; a housing that houses the recording section; a tray configured to move to a loading position in to load the medium to be subjected to recording and ejected and a stowage position in which the tray is stowed in the housing; and a switching unit that switches between an automatic mode in which to automatically move the tray to the loading position and the stowage position and a manual mode in which to manually move the tray to the loading position and the stowage position.

According to this configuration, since the tray can switch between the automatic mode in which to automatically perform an action of expanding and contracting the tray and the manual mode in which to manually perform the action, a user can select between the automatic mode and the manual mode. This makes it possible to improve the convenience with which the tray expands and contracts.

The foregoing recording apparatus may further include a control section that controls the switching unit. In the foregoing recording apparatus, the control section may switch between the automatic mode and the manual mode by controlling the switching unit.

The foregoing recording apparatus may further include: a gear train mechanism that moves the tray to the loading position and the stowage position; and a driving source that drives the gear train mechanism. In the foregoing recording mechanism, the switching unit may have a planet gear in the gear train mechanism, and switching between the automatic mode and the manual mode may be done by switching the planet gear from one position to another.

This configuration includes the gear train mechanism and the driving source, and the gear train mechanism has the plant gear. Moreover, the automatic mode and the manual mode are switched between depending on the position of the planet gear. This makes it possible to easily switch between the automatic mode and the manual mode and easily move the tray to the loading position and the stowage position.

In the foregoing recording apparatus, the tray may have formed therein a rack that meshes with the gear train mechanism, the gear train mechanism may include a pinion that meshes with the rack, and a plurality of gears that transmits motive power to the pinion, in the automatic mode, the planet gear may be brought into a meshing state of meshing with the plurality of gears, and in the manual mode, the planet gear may be brought into a non-meshing state of not meshing with the plurality of gears.

According to this configuration, in the automatic mode, the planet gear is brought into the meshing state of meshing with the gear; therefore, the motive power of the driving source is transmitted in the order of the planet gear, the gear, the pinion, and the rack, whereby the tray moves to the loading position and the stowage position. Further, in the manual mode, the planet gear is brought into the non-meshing state of not meshing with the gear; therefore, when the tray has been manually moved to the loading position and the stowage position, motive power entailed by the movement of the tray is transmitted in the order of the rack and the gear. However, since the planet gear is brought into the non-meshing state of not meshing with the gear, the motive power is not transmitted from the gear to the planet gear. This makes it possible to smoothly manually move the tray. Further, since the motive power entailed by the movement of the tray is not transmitted to the driving source, application of a load (counter electromotive force) to the driving source can be prevented.

In the foregoing recording apparatus, after the tray moves to the loading position or the stowage position in the automatic mode, the planet gear may move to a retreat position where the planet gear is in the non-meshing state of not meshing with the gear.

This configuration makes it possible to smoothly move the tray and prevent application of a load to the driving source even when the tray has been intentionally or unexpectedly moved in the direction of ejection or a direction toward the stowage position after the tray has moved to the loading position or the stowage position, as the planet gear has moved to a retreat position where the planet gear is in the non-meshing state of not meshing with the gear.

The foregoing recording apparatus may further include an operation section that inputs, to the control section, an instruction to switch between the automatic mode and the manual mode.

This configuration allows the user to easily switch between the automatic mode and the manual mode.

In the foregoing recording apparatus, the tray may be configured to move to a plurality of positions in the automatic mode.

In the foregoing recording apparatus, the tray may include a first tray and a second tray located upstream of the first tray in a direction of ejection of the medium in the loading position, and the second tray may be configured to move to a plurality of positions in the automatic mode.

According to this configuration, the second tray is configured to be movable to the plurality of positions in the automatic mode. This makes it possible to place the tray in a loading position corresponding to the size of the medium and properly load the medium to be ejected. Further, since the tray can be moved to the plurality of positions by adjusting only the second tray, the configuration of the tray and the gear train mechanism and the control of the control section can be made easy.

What is claimed is:

1. A recording apparatus comprising:

a recording section that performs recording on a medium;

a housing that houses the recording section;

a tray configured to move to a loading position in which to load the medium to be subjected to recording and ejected and a stowage position in which the tray is stowed in the housing; and a switching unit that switches between an automatic mode in which to automatically move the tray to the loading position and the stowage position and a manual mode in which to manually move the tray to the loading position and the stowage position.

2. The recording apparatus according to claim 1, further comprising a control section that controls the switching unit, wherein the control section switches between the automatic mode and the manual mode by controlling the switching unit.

3. The recording apparatus according to claim 2, further comprising:

a gear train mechanism that moves the tray to the loading position and the stowage position; and a driving source that drives the gear train mechanism, wherein the switching unit has a planet gear in the gear train mechanism, and switching between the automatic mode and the manual mode is done by switching the planet gear from one position to another.

4. The recording apparatus according to claim 3, wherein the tray has formed therein a rack that meshes with the gear train mechanism, the gear train mechanism includes a pinion that meshes with the rack, and a plurality of gears that transmits motive power to the pinion, in the automatic mode, the planet gear is brought into a meshing state of meshing with the plurality of gears, and in the manual mode, the planet gear is brought into a non-meshing state of not meshing with the plurality of gears.

5. The recording apparatus according to claim 3, wherein after the tray moves to the loading position or the stowage position in the automatic mode, the planet gear moves to a retreat position where the planet gear is in a non-meshing state of not meshing with the gear.

6. The recording apparatus according to claim 4, wherein after the tray moves to the loading position or the stowage position in the automatic mode, the planet gear moves to a retreat position where the planet gear is in the non-meshing state of not meshing with the gear train mechanism.

7. The recording apparatus according to claim 2, further comprising an operation section that inputs, to the control section, an instruction to switch between the automatic mode and the manual mode.

8. The recording apparatus according to claim 1, wherein the tray is configured to move to a plurality of positions in the automatic mode.

9. The recording apparatus according to claim 8, wherein the tray includes a first tray and a second tray located upstream of the first tray in a direction of ejection of the medium in the loading position, and the second tray is configured to move to a plurality of positions in the automatic mode.

* * * * *